US008189315B2

(12) United States Patent
Boy et al.

(10) Patent No.: US 8,189,315 B2
(45) Date of Patent: May 29, 2012

(54) SURGE ARRESTER WITH LOW RESPONSE SURGE VOLTAGE

(75) Inventors: Juergen Boy, Berlin (DE); Wolfgang Daeumer, Zeuthen (DE)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 12/817,917

(22) Filed: Jun. 17, 2010

(65) Prior Publication Data

US 2010/0309598 A1 Dec. 9, 2010

Related U.S. Application Data

(63) Continuation of application No. PCT/EP2008/011094, filed on Dec. 22, 2008.

(30) Foreign Application Priority Data

Dec. 28, 2007 (DE) ..... 10 2007 063 316

(51) Int. Cl.
*H02H 1/04* (2006.01)

(52) U.S. Cl. ..... 361/117

(58) Field of Classification Search ..... 361/117
See application file for complete search history.

(56) References Cited

U.S. PATENT DOCUMENTS

| | | | | |
|---|---|---|---|---|
| 4,156,886 A | | 5/1979 | Jones | |
| 4,433,354 A | | 2/1984 | Lange et al. | |
| 4,493,004 A | * | 1/1985 | Lange et al. | 361/120 |
| 4,769,736 A | | 9/1988 | Boy | |
| 5,336,970 A | | 8/1994 | Einbinder | |
| 5,569,972 A | | 10/1996 | Lange | |
| 5,633,777 A | * | 5/1997 | Boy et al. | 361/117 |
| 5,768,082 A | * | 6/1998 | Lange et al. | 361/120 |
| 5,936,822 A | * | 8/1999 | Bazarian | 361/117 |
| 6,147,585 A | * | 11/2000 | Kalra et al. | 337/248 |
| 6,362,945 B1 | | 3/2002 | Bobert et al. | |
| 6,710,996 B2 | * | 3/2004 | Bobert et al. | 361/117 |

FOREIGN PATENT DOCUMENTS

| | | |
|---|---|---|
| DE | 43 30 178 B4 | 3/1995 |
| DE | 199 20 043 A1 | 10/2000 |
| EP | 0 251 010 A1 | 1/1988 |
| WO | WO 2007/033247 A2 | 3/2007 |

OTHER PUBLICATIONS

"Surge Arrrester; 3-Electrode Arrester," T30-A230XG, B88069X3010T702, Nov. 14, 2007, pp. 1-4, Issue 4, EPCOS.

* cited by examiner

*Primary Examiner* — Jared Fureman
*Assistant Examiner* — Scott Bauer
(74) *Attorney, Agent, or Firm* — Slater & Matsil, L.L.P.

(57) ABSTRACT

A surge arrester includes two side electrodes extending into an interior space formed by means of at least one insulating body and a central electrode. The end-side distance between the side electrodes is greater than the distances between a respective side electrode and the central electrode. The distance between the side electrodes is less than the distance between the end regions of the central electrode and a base of the side electrodes.

17 Claims, 3 Drawing Sheets

SURGE ARRESTER WITH LOW RESPONSE SURGE VOLTAGE

This application is a continuation of co-pending International Application No. PCT/EP2008/011094, filed Dec. 22, 2008, which designated the United States and was not published in English, and which claims priority to German Application No. 10 2007 063 316.7 filed Dec. 28, 2007, both of which applications are incorporated herein by reference.

TECHNICAL FIELD

The invention relates to a surge arrester with low response surge voltage and to the use thereof.

BACKGROUND

The document DE 4330178 B4 discloses a surge arrester.

In the interior of the surge arrester, when a specific limit voltage, the ignition voltage, is exceeded, an arc flashover occurs between two of the three electrodes. The limit voltage is designated as response DC voltage Urdc in the case of static or steady-state loading with a voltage rise of 100 V/s, and as response surge voltage Urs in the case of dynamic loading with a voltage rise of 1 kV/μs. The arc is maintained by the feeding current as long as the electrical conditions for the arc exist.

SUMMARY OF THE INVENTION

In one aspect, the invention specifies a surge arrester that has a low response surge voltage, and also a use therefore.

The surge arrester comprises an interior space formed by at least an insulating body, a central electrode and two side electrodes. The surge arrester is a three-electrode surge arrester. The electrodes of the surge arrester are connected in particular by means of at least one tubular insulating body, preferably at least one ceramic cylinder, to form the surge arrester. The surge arrester is designed with its side electrodes extending into the region of the central electrode such that in the interior space the distance between the side electrodes is greater than the distances between a respective side electrode and the central electrode, but less than between the end regions of the central electrode and a base of the side electrodes. The surge arrester is designed such that the response surge voltage in the case of a voltage rise of 1 kV/μs is less than 2.2 times the nominal response DC voltage and predetermined parameters of the central electrode and of one of the side electrodes are identical.

Particularly advantageously, the surge arrester is embodied in cylindrical fashion with an external diameter of less than 8 mm. In an especially preferred embodiment, the surge arrester has an external diameter of at most 5 mm. The particularly small design and the outstanding electrical values give rise to diverse possibilities for use, in particular for protecting small electronic devices.

The surge arrester is advantageously distinguished by the fact that, at a nominal response DC voltage of 230 V, the response surge voltage is less than 500 V and the parameters for the rated AC current and the rated surge current between a respective side electrode relative to the central electrode are symmetrical and identical. Even if the nominal response DC voltage fluctuates by +/−20%, the surge arrester is advantageously distinguished by a response surge voltage of less than 500 V.

At a rated AC current of 10 A during the period of 1 s, this means in each case a current of 5 A that flows from each of the side electrodes to the central electrode. The surge arrester advantageously permits a ten-fold repetition of the loading with the rated AC current.

At a rated surge current of 10 kA of the normalized form 8/20, i.e. a rise time of 8 μs and a time to half-value of 20 μs, this means in each case a current of +/−5 kA that flows from each of the side electrodes to the central electrode. The surge arrester advantageously permits a ten-fold repetition of the loading with the rated surge current.

At a surge current of 200 A of the normalized form 10/1000, i.e. a rise time of 10 μs and a time to half-value of 1000 μs, this means in each case a current of 100 A that flows from each of the side electrodes to the central electrode. The surge arrester advantageously permits a 300-fold repetition of the loading with this surge current characterizing the lifetime and loading capacity.

The interior space of the surge arrester is closed off from the surroundings in a gastight manner. A gas is situated in the interior space of the surge arrester. As a result, the parameters of the surge arrester advantageously arise in a reproducible manner.

The surge arrester is preferably used in a telecommunication apparatus, for example a telecommunication network; however, it is not restricted to telecommunication networks and can also be used in any other electrical circuit in which high voltages have to be dissipated by means of a surge arrester. In particular, the surge arrester is suitable for lightning protection applications in which the surge arrester is, or can be, at symmetrical voltages with respect to ground at least at times.

In one advantageous embodiment, the side electrodes and the central electrode are embodied in composite fashion. The embodiment makes it possible, through the use of different metals and/or alloys, to provide optimized arrester conditions for the interior space and at the same time to afford very good soldering or welding properties for the external connections of the electrodes.

It proves to be advantageous to use copper for the electrodes in the interior space of the surge arrester and to provide the external connections composed of an iron-nickel alloy. Particularly advantageously, the iron-nickel alloy, e.g. $Fe_{58}Ni_{42}$, is copper-plated. It is thereby possible to achieve optimal properties in the interior space and in the case of the closure soldering of the surge arrester.

In one preferred embodiment, the central electrode is composed of a tube part, in particular made of copper, and a ring part, in particular made of iron-nickel. The tube part either has a constant wall thickness or contains a bead in the region of the ring part.

An embodiment in which the gastight and gas-filled interior space of the surge arrester contains a hydrogen additive is particularly advantageous. The proportion of hydrogen is permitted to be between 5% and 30%; a hydrogen additive of approximately 20% is typical, however. As a result, the build-up time for a discharge upon the response of the surge arrester is shortened and the response surge voltage is reduced.

In order to support the build-up of a discharge upon the response of the surge arrester, it proves to be advantageous if the interior space contains a plurality of ignition strips at the inner wall of the insulating body. The ignition strips are either electrically connected to one of the side electrodes and extend right into the discharge rear space behind the central electrode, but not as far as deep into the rear space of the respective other side electrode. Wall discharges are thereby avoided. As an alternative, the ignition strips are not connected to any of the electrodes. In a further embodiment, both alternatives of the ignition strip arrangement are advantageously used.

In a further advantageous embodiment, the pin-shaped side electrodes have a honeycomb structure of the surface at the end side in order to take up an activating compound in the depressions. The activating compound has a positive effect on a discharge build-up and the reproducibility thereof.

The surge arrester is explained in greater detail below on the basis of exemplary embodiments and the associated figures.

BRIEF DESCRIPTION OF THE DRAWINGS

The drawings described below should not be regarded as true to scale. Rather, individual dimensions may be illustrated as enlarged, reduced in size or even distorted, for the sake of improved illustration.

Identical elements or elements having identical functions are designated by the same reference symbols.

The following list of reference symbols may be used in conjunction with the drawings:

| | |
|---|---|
| 1, 10 | Surge arrester |
| 2 | Side electrode |
| 3 | Side electrode |
| 4 | Insulating body |
| 5 | Central electrode |
| 6 | Ignition strip |
| 7 | Closure soldering |
| 8 | Honeycomb structure |
| 9 | Electrode soldering |
| 11 | Solder ring |
| 12 | Short-circuiting link |
| 13 | Film |
| 14 | Connecting wire |
| 15 | Connecting wire |
| 16 | Connecting wire |

DETAILED DESCRIPTION OF ILLUSTRATIVE EMBODIMENTS

Figure 1:
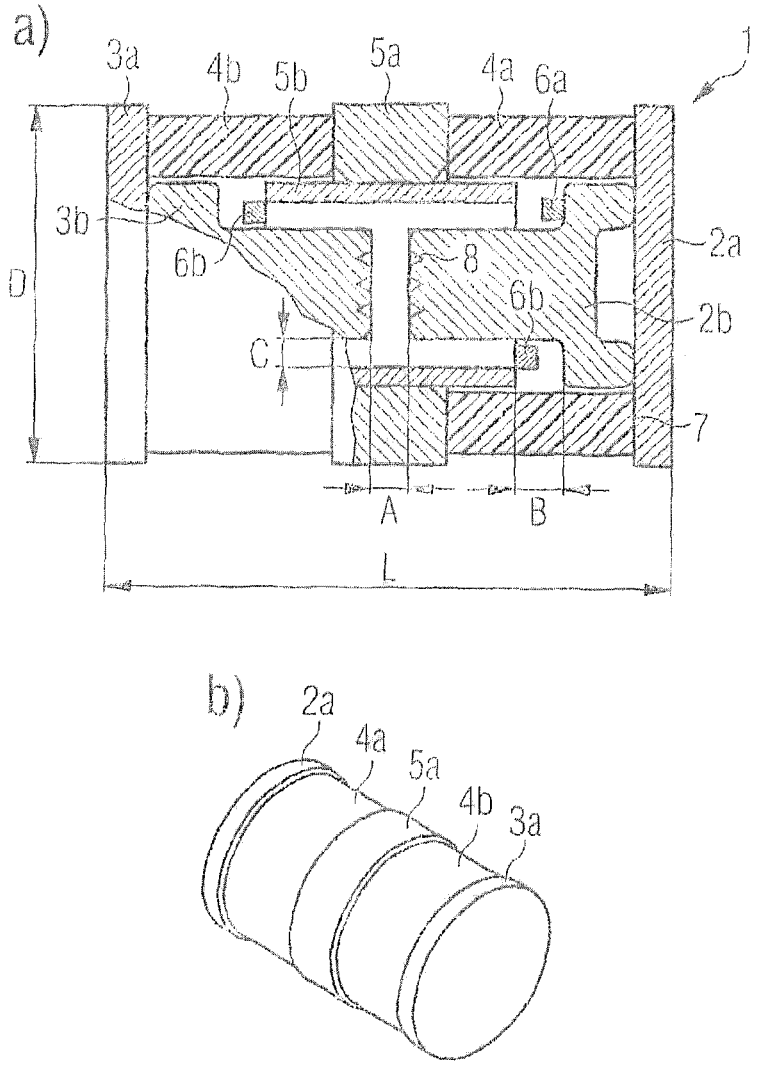
FIG. 1 shows a schematic diagram of a surge arrester in partial cross section with side electrodes and a central electrode.

FIG. 1 illustrates a first embodiment of a surge arrester 1 in (partial) cross section. The surge arrester has two side electrodes composed of in each case two parts 2*a*, 2*b* and 3*a*, 3*b*. The side electrodes laterally terminate two insulating bodies 4*a*, 4*b* by means of a closure soldering 7. A central electrode 5*a*, 5*b* is arranged centrally between the insulating bodies, which are tubular and are made of ceramic, said central electrode likewise being composite. The interior space of the surge arrester thus formed is closed off in gastight fashion and contains a gas having a hydrogen proportion of between 5% and 30%, but in particular a proportion of 20%.

The side electrodes have a respective FeNi disk 2*a*, 3*a* on the outside, said disk being copper-plated. The disks are stamped parts or cold-extruded parts. With a soldering connection 9 by means of an SCP or AgCu solder or with a welding connection, the disks are combined with a respective electrode 2*b*, 3*b* made of copper projecting into the interior space. Each electrode 2*b*, 3*b* is a turned part or a cold-extruded part and has a cup-shaped electrode base soldered to the disk 2*a*, 3*a* and a pin-shaped part having a honeycomb structure 8 for taking up an activating compound at the end side. The diameter of the electrode base is chosen so as to guide the electrode in the ceramic tube 4. The pin-shaped part of each side electrode 2, 3 projects into the tubular region of the central electrode 5. The distance between the end sides of the side electrodes is A.

Figure 2:
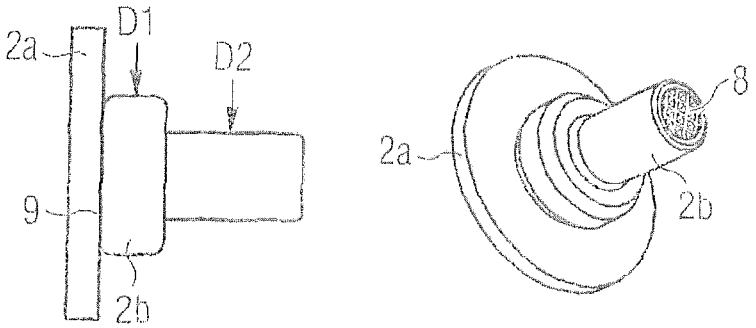
FIG. 2 shows a side electrode of a surge arrester with a covering disk.

In the exemplary embodiment in FIG. 1, the electrode base has a diameter D1 of 2.8 mm, while the pin-shaped part has a diameter D2 of 1.6 mm, see FIG. 2. The internal diameter of the insulating body 4 is 2.8 mm.

Figure 3:
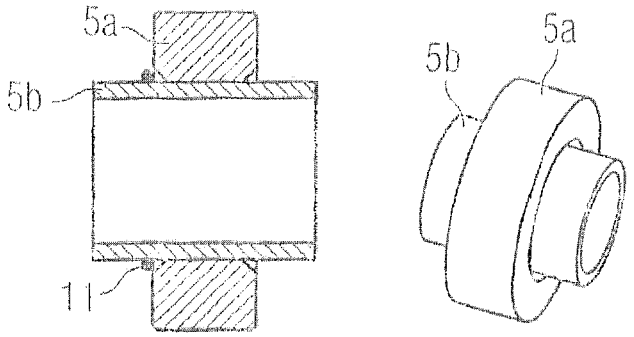
FIG. 3 shows a schematic diagram of a central electrode of a surge arrester.

In accordance with FIG. 3, the central electrode 5 is composed of a tube part 5*b* having a small wall thickness and a ring part 5*a*. The tube part 5*b* is made of copper or an iron-nickel alloy, which is preferably copper-plated. The length of the tube part is designed such that it shades the insulating bodies 4*a*, 4*b* in the case of a discharge and prevents a discharge from penetrating into the region of the insulating body. At the same time, the distance B between the edge of the tube part 5*b* and the base of the side electrode 2*b*, 3*b* is greater than the internal electrode distance C in a radial direction. A secondary discharge is thus reliably prevented. In one particularly advantageous embodiment, the tube part is pasted with an activating compound.

The distance A in a longitudinal direction is greater than the distance C in a radial direction, but less than the distance B.

In the exemplary embodiment, A=0.56 mm, B=0.68 mm and C=0.4 mm. The external diameter of the tube part 5*b* is approximately 2.8 mm, but is in any event slightly smaller than the internal diameter of the insulating body.

Centrally, the tube part 5*b* is enclosed by a ring part 5*a* made, preferably, of an iron-nickel alloy. The ring part can be copper-plated. With the ring part, the central electrode can be guided symmetrically with respect to the insulating bodies.

In accordance with FIG. 3, the central electrode is produced by a soldering 11 or by a precisely fitting interconnection or by spot welding with the aid of a laser. In the latter method, during preassembly, the tube 5*b* is positioned concentrically in the ring 5*a* and fixedly spot-welded at least on one side by means of one or a plurality of welding spots in the gap between the tube 5*b* and the ring 5*a*. An electrically reliable contact-connection between the tube 5*b* and the ring 5*a* is then ensured in the case of the closure soldering for example by means of a soldering foil bearing thereon. The electrode guiding of the central electrode at the inner wall of the insulating bodies 4 is expediently effected during the closure soldering of the surge arrester by means of the higher coefficient of thermal expansion of the metallic central electrode 5 relative to the insulating bodies 4 made of ceramic. The side electrodes are also guided during the closure soldering at the internal diameter of the ceramic insulating body.

The surge arrester has ignition strips 6 at the inner wall of the insulating bodies 4. The ignition strips 6*a* are connected to a side electrode and do not extend beyond the center of the surge arrester. The ignition strips 6*b* project into the discharge space, but are not connected to any electrode.

Figure 4:
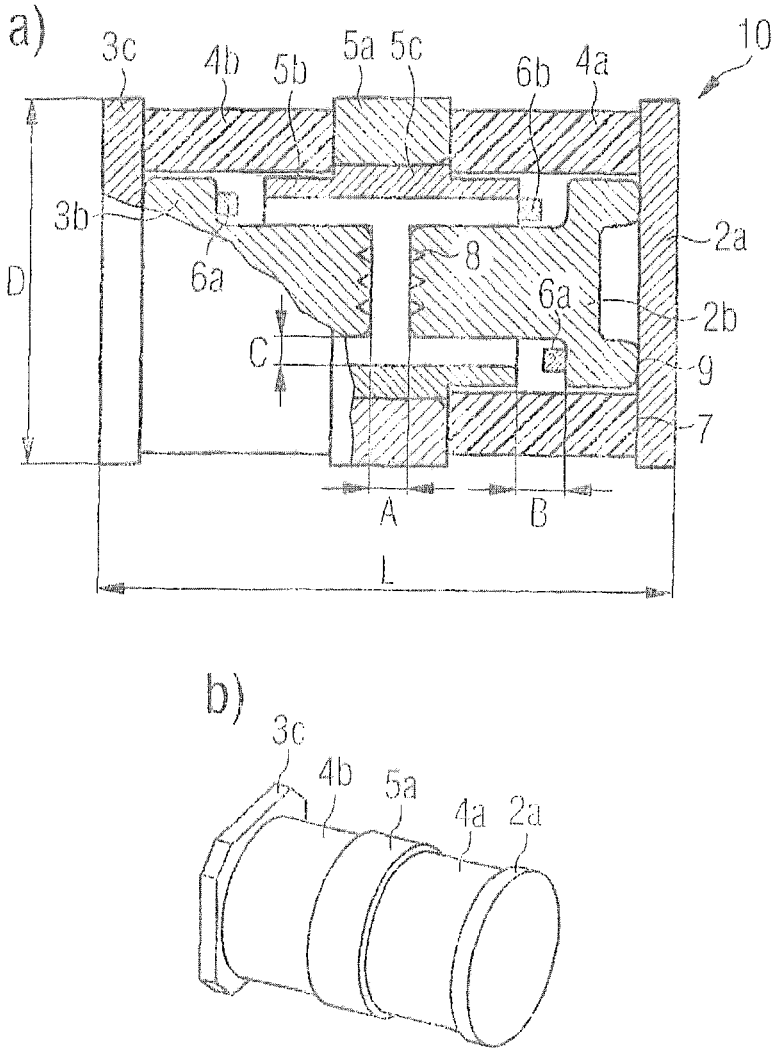
FIG. 4 shows a schematic diagram of a surge arrester in partial cross section with side electrodes and a central electrode for SMD mounting.

FIG. 4 differs from FIG. 3 in that the surge arrester has SMD capability. For this purpose, the outer disk 3*c* of the side electrode 3 has an approximately square form. The tube part 5*c* of the central electrode has a bead in the region of the ring part.

Figure 5:
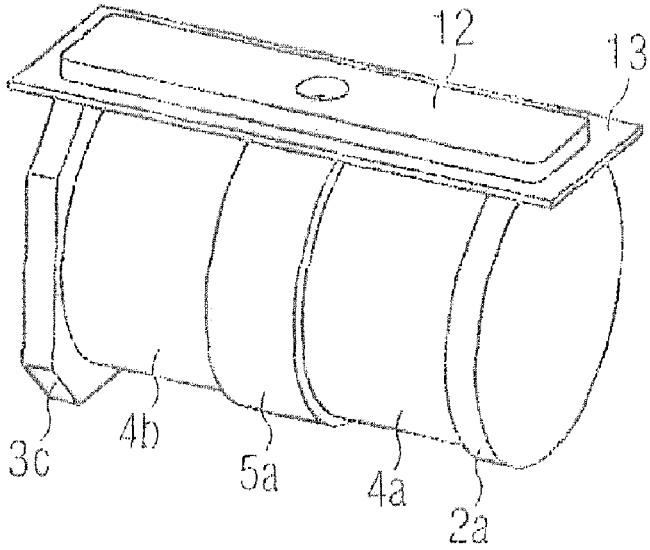
FIG. 5 shows a schematic diagram of an SMD-mountable surge arrester with a short-circuiting link.

FIG. 5 shows a surge arrester in accordance with FIG. 4, the central electrode of which has a welded-on short-circuiting link 12, which is insulated from the side electrodes by means of a film 13. As a result, the surge arrester is short-circuited with the aid of the link 12 if the thermal loading becomes so high that the film 13 melts. The short-circuiting link is made of CuBe, and the film is made of Hostaphan or polypropylene.

Figure 6:
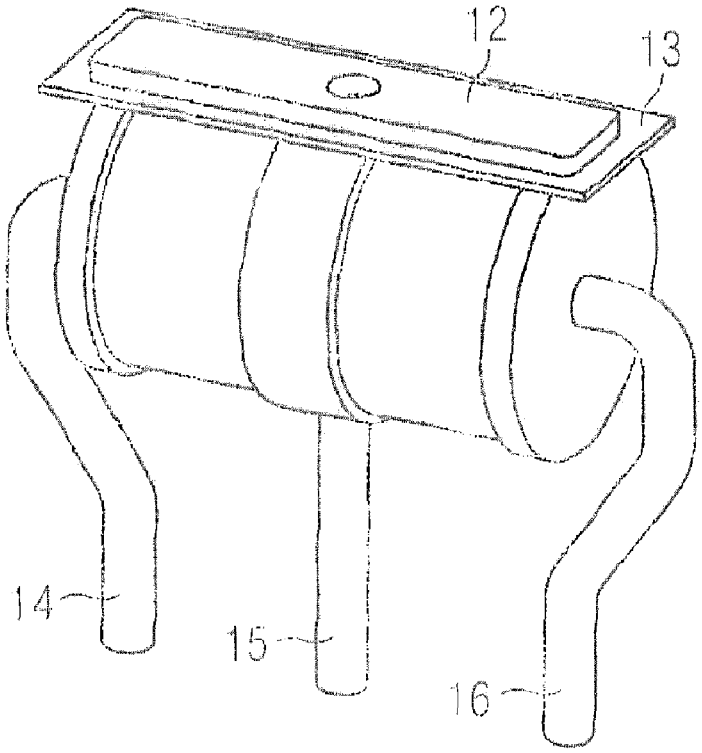
FIG. 6 shows a schematic diagram of a surge arrester with a short-circuiting link and external wiring.

FIG. 6 shows a surge arrester in accordance with FIG. 1 with a short-circuiting link 12 and triple external wiring 14, 15 and 16 of the three electrodes.

The surge arrester in accordance with the exemplary embodiments has an external diameter D of 5 mm and a length of 7.8 mm. It has the following performance features:

Response DC voltage Urdc −230 V+/−20%,

Response surge voltage Urs less than 500 V given a voltage rise of 1 kV/μs,

Rated AC current $I_{ACR}$=10 A given 1 s and 10× repetition, with in each case 5 A between a side electrode and the central electrode, Rated surge current $i_{SR}$=10 kA given 8/20 μs, and 10× repetition, with in each case the magnitude of 5 kA between a side electrode and the central electrode, and LD=200 A given a surge current of the form 10/1000 μs and 300×, with in each case 100 A between a side electrode and the central electrode.

What is claimed is:

1. A surge arrester, comprising:

an insulating body;

a first side electrode and a second electrode extending into an interior space formed by the insulating body;

a central electrode, wherein an end-side distance between the first and second side electrodes is greater than distances between a respective side electrode and the central electrode, and wherein a distance between the first and second side electrodes is less than a distance between end regions of the central electrode and a base of the side electrodes; and a plurality of ignition strips located at an inner wall of the insulating body, the ignition strips extending into a space behind the central electrode but not extending beyond a center of the surge arrester;

wherein the first and second side electrodes each comprise a first part and a second part made of different metals and/or alloys, the first part having a base and a pin-shaped part, the second part being a disk, the base having a diameter chosen so as to guide the electrode in the insulating body, the base and the pin-shaped part being located inside the insulating body.

2. The surge arrester as claimed in claim 1, which is designed such that a response surge voltage in the case of a voltage rise of 1 kV/μs is less than 2.2 times a nominal response DC voltage.

3. The surge arrester as claimed in claim 2, wherein predetermined parameters of the central electrode and of one of the side electrodes are identical.

4. The surge arrester as claimed in claim 1, wherein the surge arrester has a cylindrical form.

5. The surge arrester as claimed in claim 4, wherein the surge arrester has an external diameter of less than 8 mm.

6. The surge arrester as claimed in claim 1, wherein parts of an electrode in the interior space of the surge arrester comprise copper and externally accessible electrode parts comprise an iron-nickel alloy.

7. The surge arrester as claimed in claim 1, wherein the central electrode comprises a tube part and a ring part.

8. The surge arrester as claimed in claim 1, wherein externally accessible electrode parts of the side electrodes are round.

9. The surge arrester as claimed in claim 1, wherein externally accessible electrode parts of the side electrodes are square.

10. The surge arrester as claimed in claim 1, wherein the interior space contains a gas with a hydrogen additive.

11. The surge arrester as claimed in claim 10, wherein end faces of the side electrodes have a honeycomb structure.

12. The surge arrester as claimed in claim 1, wherein each ignition strip is in contact-connection with one of the side electrodes and is shorter than that side electrode.

13. An electronic device comprising the surge arrester as claimed in claim 1.

14. An electrical power supply system comprising the surge arrester as claimed in claim 1.

15. A surge arrester, comprising two side electrodes extending into an interior space formed at least an insulating body and a central electrode, wherein an end-side distance between the side electrodes is greater than distances between a respective side electrode and the central electrode, and the distance between the side electrodes is less than the distance between end regions of the central electrode and a base of the side electrodes, wherein each side electrode comprises first and second parts made of different metals and/or alloys, the first part having a base and a pin-shaped part, the second part being a disk, the base having a diameter chosen so as to guide the electrode in the insulating body, the base and the pin-shaped part being inside the insulating body, the surge arrester further comprising a plurality of ignition strips located at an inner wall of the insulating body, the ignition strips extending into a space behind the central electrode but not extending beyond a center of the surge arrester.

16. The surge arrester as claimed in claim 1, wherein the ignition strips are connected to one of the electrodes.

17. The surge arrester as claimed in claim 1, wherein the ignition strips are not connected to one of the electrodes.

* * * * *